US005715956A

United States Patent [19]

Yoshida

[11] Patent Number: 5,715,956

[45] Date of Patent: Feb. 10, 1998

[54] JOINT FOR MODULAR SHELVES AND MODULAR SHELF SYSTEM USING THE SAME

[75] Inventor: Tsukasa Yoshida, Saitama, Japan

[73] Assignee: NS Planning Inc., Tokyo, Japan

[21] Appl. No.: 736,502

[22] Filed: Oct. 24, 1996

[30] Foreign Application Priority Data

Oct. 30, 1995 [JP] Japan ..... 7-303340

[51] Int. Cl.[6] ..... A47F 5/14

[52] U.S. Cl. ..... 211/182; 211/186; 312/140; 403/231; 403/405.1; 403/176

[58] Field of Search ..... 211/182, 186, 211/187, 188; 312/111, 140; 403/170, 173, 176, 310, 231, 405.1, 406.1, 407.1; 108/153, 180, 193

[56] References Cited

U.S. PATENT DOCUMENTS

| | | | |
|---|---|---|---|
| 3,670,899 | 6/1972 | Kronenberg et al. | 403/231 X |
| 3,896,743 | 7/1975 | Pariente | 211/182 X |
| 4,065,220 | 12/1977 | Roga | 403/176 X |
| 4,493,425 | 1/1985 | Yoshida | 211/182 X |
| 4,516,376 | 5/1985 | King | 403/176 X |
| 4,650,261 | 3/1987 | Winter et al. | 211/186 X |
| 5,470,139 | 11/1995 | Hsiao | 312/140 |

FOREIGN PATENT DOCUMENTS

| | | | |
|---|---|---|---|
| 1480683 | 4/1967 | France | 211/182 |

*Primary Examiner*—Peter M. Cuomo
*Assistant Examiner*—James O. Hansen
*Attorney, Agent, or Firm*—Sughrue, Mion, Zinn, Macpeak & Seas, PLLC

[57] ABSTRACT

A joint for modular shelves which allows assembly or disassembly of shelves more simply in a short period of time, and a modular shelf system using the same. The joint includes a flattered columnar body, one end surface of which forms a front surface and the other end surface of which forms a rear surface. A circumferential side surface of the flattened columnar body is provided with left and right rear frame-fitting slits extending in parallel with the front surface, side frame-fitting slits extending in right angles to the rear frame-fitting slits, and L-shaped shelf-fitting slits which have first side parts extending along the rear frame-fitting slits and second side parts extending along the side frame-fitting slits and which are provided on the left and right sides of the side frame-fitting slits. These slits include both upwardly opened slits and downwardly opened slits.

8 Claims, 6 Drawing Sheets

FIG. 5
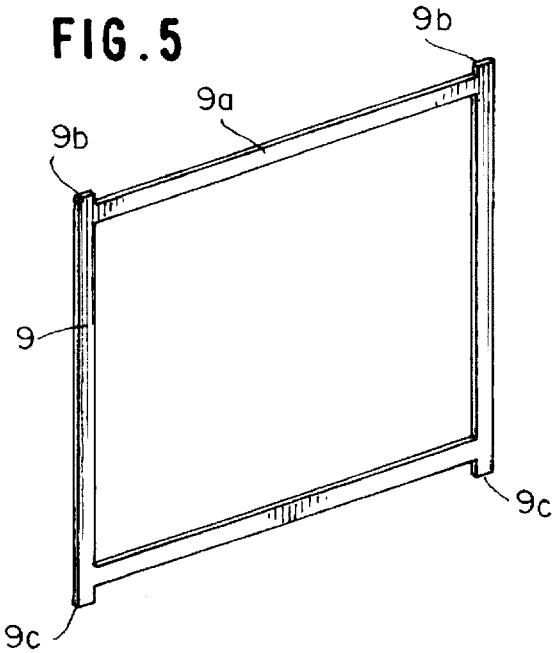
FIG. 8
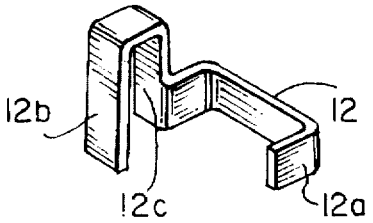
FIG. 7
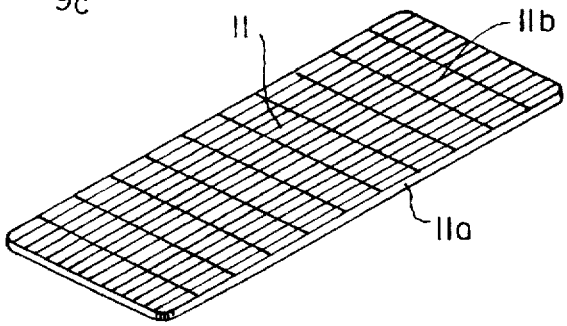
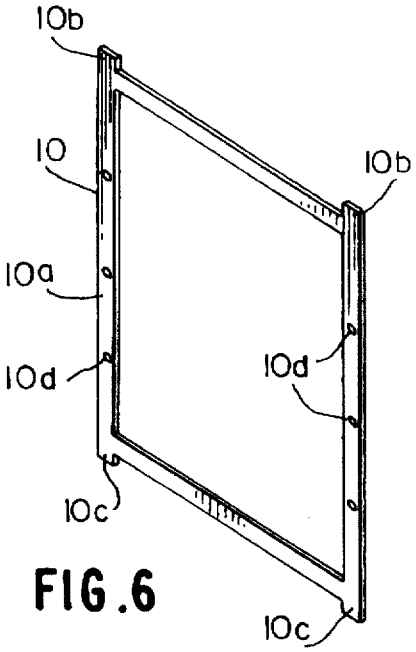
FIG. 6
FIG. 9
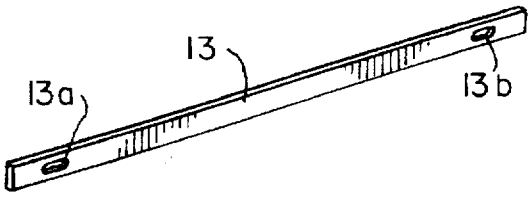
FIG. 10
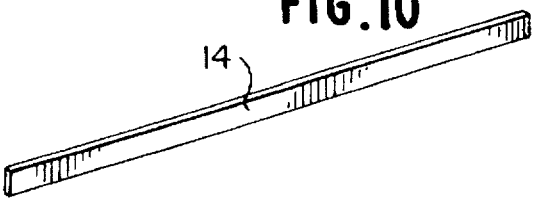
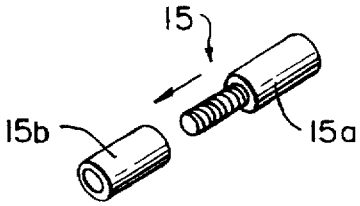
FIG. 11

FIG. 15
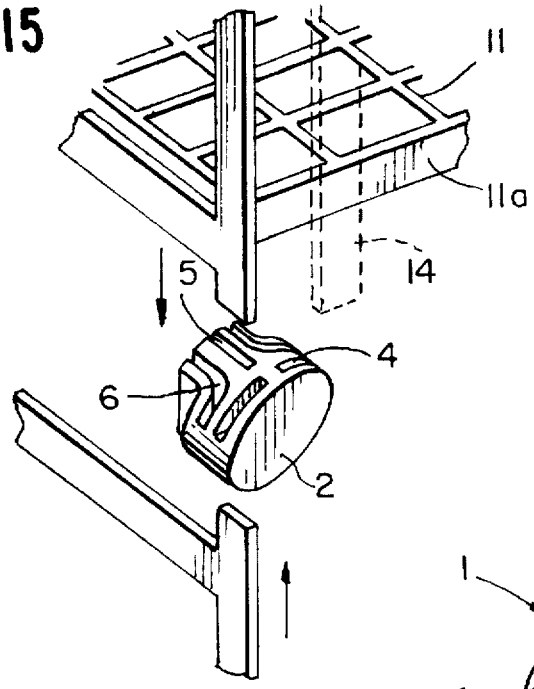
FIG. 16
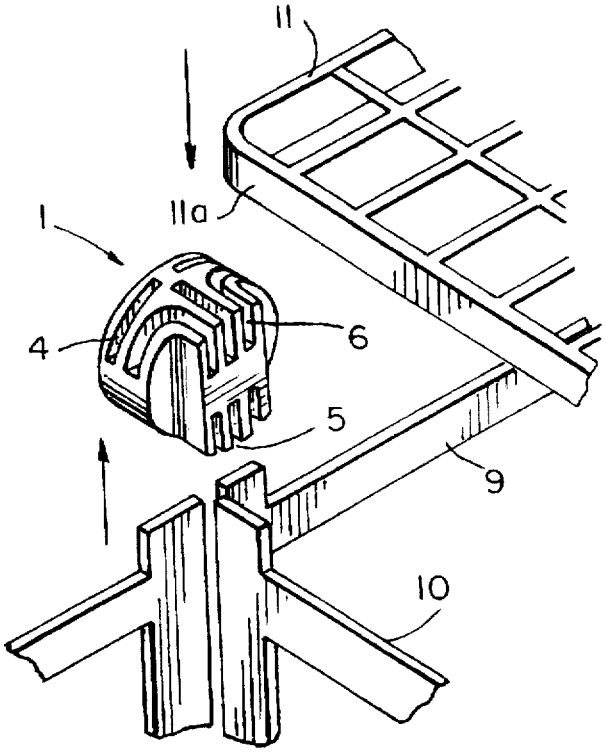
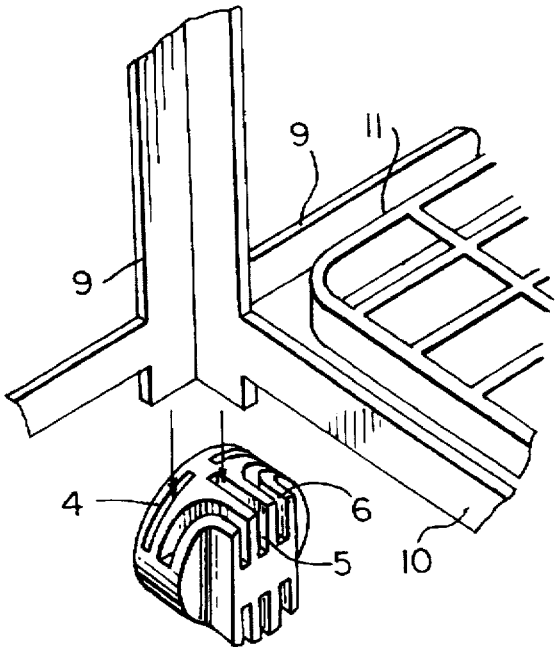
FIG. 17

FIG. 20
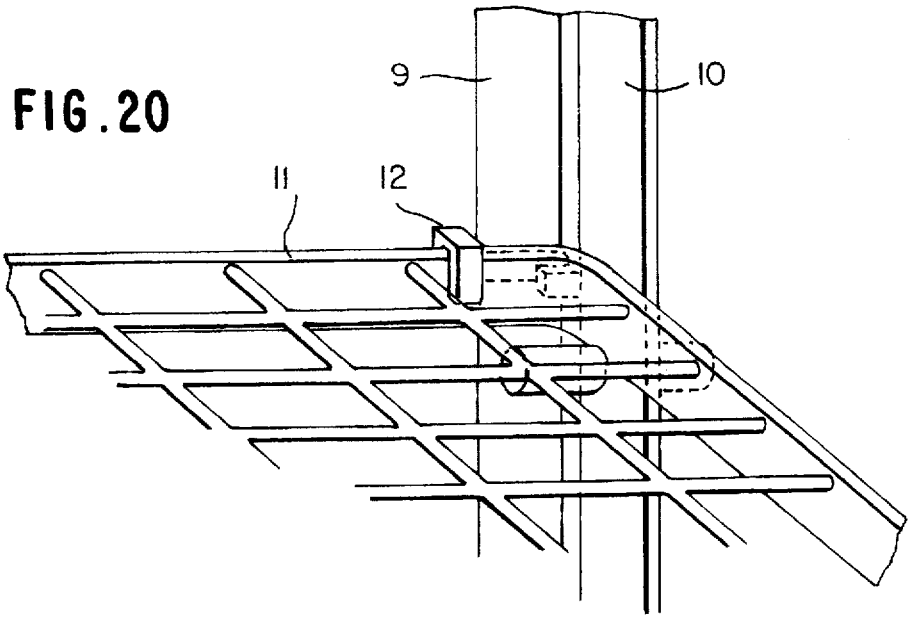
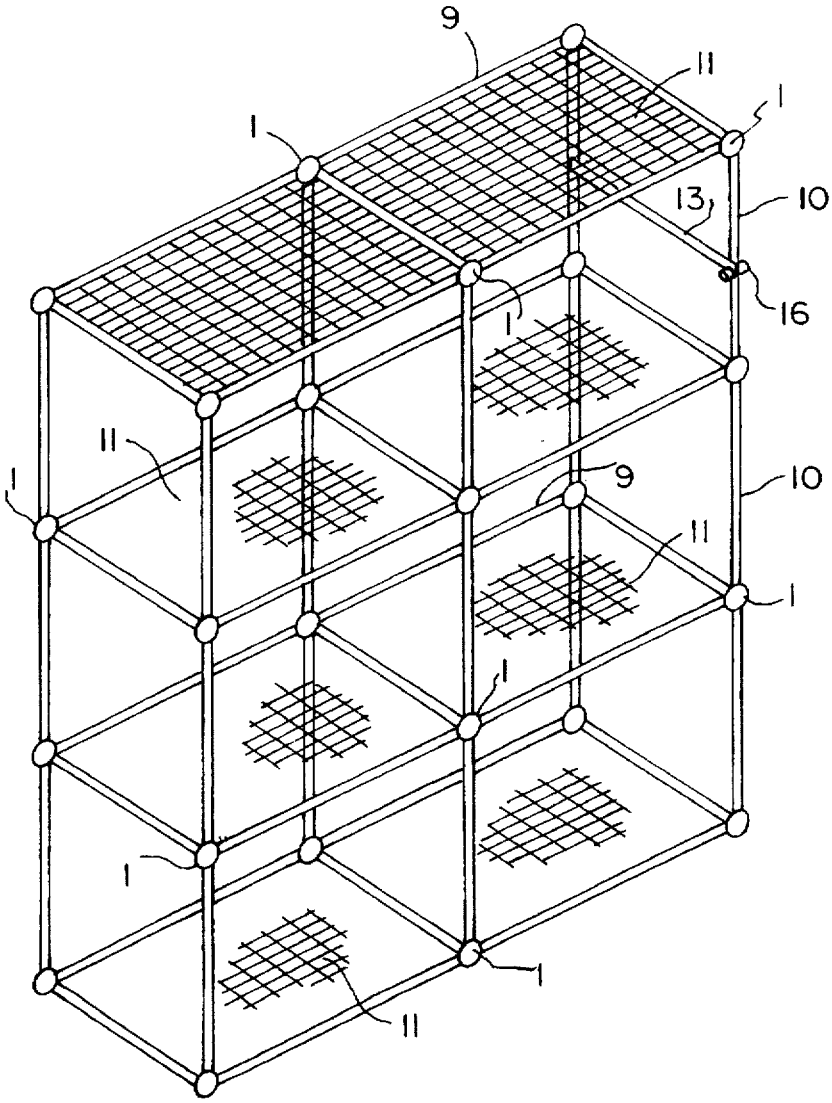
FIG. 21

JOINT FOR MODULAR SHELVES AND MODULAR SHELF SYSTEM USING THE SAME

FIELD OF THE INVENTION

The present invention relates to a joint for modular shelves used, for example, as domestic display shelves on which a television set, ornaments, books or the like are placed, or as merchandise display shelves, and to a modular shelf using the same.

BACKGROUND OF THE INVENTION

Various types of conventional joint for use in assembling a modular shelf are known. However, the known conventional joints have many parts and require a complicated process for assembling a modular shelf system. Moreover, a modular shelf system assembled using such joints often has parts not fixed together firmly, so that such a shelf tends to be somewhat unstable and rickety in many cases.

SUMMARY OF THE INVENTION

The present invention has been developed so as to solve these problems, and an object of the invention is the provision of a joint for modular shelves which enables a shelf to be assembled and disassembled simply in a short period of time. Another object of the invention is to provide a strong modular shelf system using such joints.

To achieve the above and other objects, the present invention provides a joint for modular shelves comprising a flattened columnar body, one end surface of which forms a front surface, and the other end surface of which forms a rear surface, characterized in that at least one circumferential side surface of the flattened columnar body is provided with left and right rear frame-fitting slits extending in parallel with the front surface, side frame-fitting slits extending at right angles to the rear frame-fitting slits, and L-shaped shelf-fitting slits which comprise first side parts extending along the rear frame-fitting slits and second side parts extending along the side frame-fitting slits, and which are provided on the left and right sides of the side frame-fitting slits, the three kinds of slits comprising upwardly opened slits and downwardly opened slits. The invention also provides a modular shelf system using such joints for modular shelves.

BRIEF DESCRIPTION OF THE DRAWINGS

FIG. 5 is perspective view of a rear frame.

FIG. 6 is a perspective view of a side frame.

FIG. 7 is a perspective view of a reticulate shelf.

FIG. 8 is a perspective view of a cleat for the reticulate shelf.

FIG. 9 is a perspective view of a lateral strip.

FIG. 10 is a perspective view of a front portion reinforcing bar.

FIG. 11 perspective view of a shelf-receiving pin.

FIG. 15 is an exploded perspective view of the joint, a side frame and a reticulate frame fitted therein from the upper side, and a side frame fitted therein from the lower side.

FIG. 16 is an exploded perspective view of the joint, a reticulate shelf fitted therein from the upper side, and left and right rear frames and a side frame fitted therein from the lower side.

FIG. 17 is an exploded perspective view of the joint, and a reticulate shelf, left and right rear frames and a side frame fitted therein from the upper side thereof.

FIG. 20 is a perspective view of a reticulate shelf fixed to the intermediate portions of rear side frames.

FIG. 21 is a perspective view of an example of a complete modular shelf system.

DESCRIPTION OF THE PREFERRED EMBODIMENTS

Figure 1:
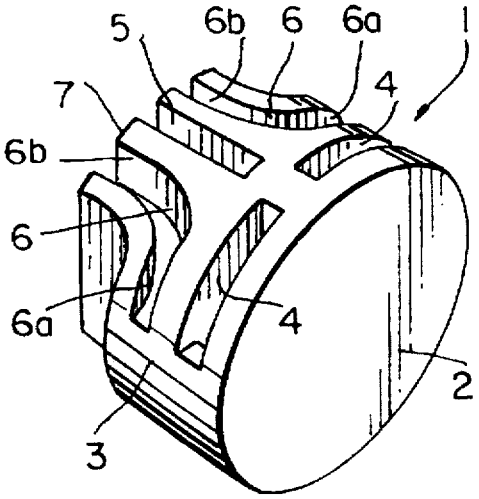
FIG. 1 is a perspective view of a joint of the invention taken from the front side.
Figure 3:
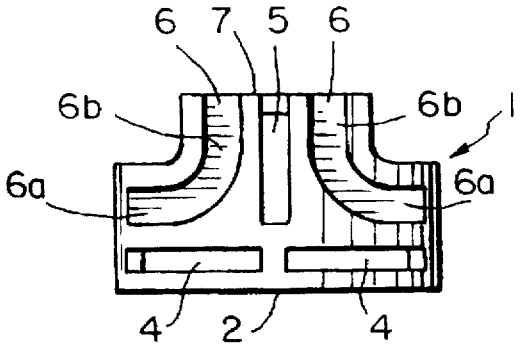
FIG. 3 is a plan view (bottom view) of the joint.
Figure 2:
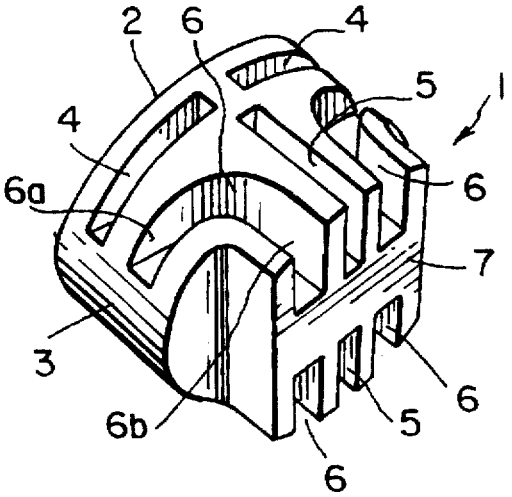
FIG. 2 is a perspective view of the joint taken from the rear side.
Figure 4:
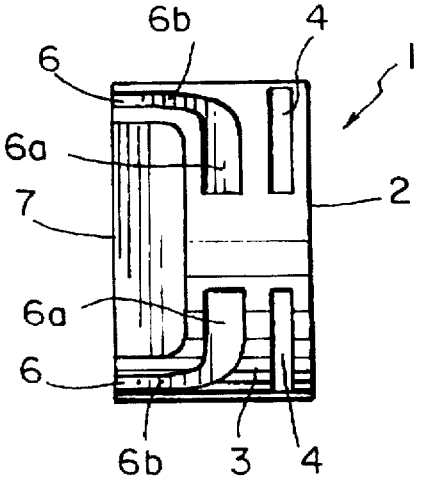
FIG. 4 is a left side view of the joint.

The present invention will now be described on the basis of the illustrated embodiments.

With reference first to FIGS. 1–4 of the attached drawings, reference numeral 1 denotes a joint constructed according to the present invention. This joint 1, which is formed from a synthetic resin, has a substantially flattened columnar body, a right circular end surface of which defines a front surface 2. Two portions of a rear part of a circumferential side surface 3 of the columnar body are cut off so as to form symmetrically curved recesses.

The circumferential side surface 3 is provided in an upper haft portion thereof with upwardly opened rear frame-fitting slits 4, side frame-fitting slits 5 and shelf-fitting slits 6, and in a lower haft portion thereof with downwardly opened rear frame-fitting slits 4, side frame-fitting slits 5 and shelf-fitting slits 6 of completely the same design.

The columnar body is provided in each half portion thereof with two rear frame-fitting slits 4 which extend from a widthwise intermediate portion of the circumferential surface of the columnar body to left and right and in parallel with the front surface 2. The slits 4 are four in total, including two upwardly opened slits and two downwardly opened slits.

Linear side frame-fitting slits 5 are also provided, which extend from rear portions of the rear frame-fitting slits 4 along the widthwise intermediate portion of the columnar body, i.e., in the longitudinal direction (perpendicular to the slits 4) thereof. The slits 5 are two in total, including an upwardly opened slit and a downwardly opened slit formed completely identically with and on the opposite side of the upwardly opened slit. The slits 5 are also opened in a rear surface 7. These upper and lower slits 5 communicate with each other in the interior of the columnar body.

Shelf-fitting slits 6 are provided in the portions of the columnar body on the rear side of the rear frame-fitting slits 4 and on both sides of the side frame-fitting slits 5. Each of the slits 6 is formed in the shape of the letter "L", i.e., each of the slits 6 is bent at its intermediate portion. One side part 6a of the slit 6 extends along and in parallel with the adjacent rear frame-fitting slit 4, and the other side part 6b along and in parallel with an adjacent side frame-fitting slit 5, the bent portion of the slit 6 being formed arcuately. A total of four slits 6 are provided, which include two upwardly opened slits 6 provided on the left and right sides of the relative slit 5, and two downwardly opened slits 6 provided in completely the same manner on the left and right sides of the slit 5 on the opposite side of the above slit 5.

Figure 18:
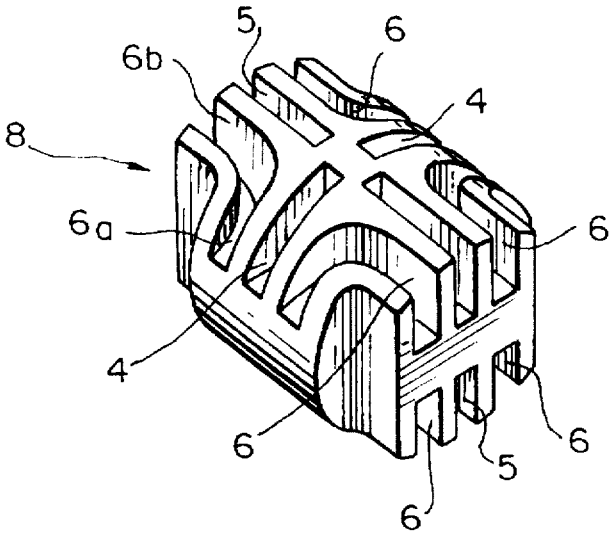
FIG. 18 a perspective view of a joint used when not less than two rows of shelves are assembled in the depthwise direction.

Reference numeral 8 denotes a joint used on rear portions of shelves so as to connect longitudinally adjacent frames together when not less than two longitudinally adjacent rows of shelves are assembled. As shown in FIG. 18, this joint 8 has an integral structure which is a combination of two of the previously described joints 1 fixed back-to-back at their respective front surfaces 2 with both end portions of a flattened columnar body of the joint 8 cut off longitudinally and arcuately.

The columnar body is provided in an axially intermediate portion thereof with one row of circumferentially extending rear frame-fitting slits 4. The slits 4 are four in total, including two left and right upwardly opened slits 4 and two left and right downwardly opened slits 4 formed in completely the same manner as and on the opposite side of the upwardly opened slits 4.

Side frame-fitting slits 5 are also provided extending in the axial (longitudinal) direction, i.e., at right angles to the rear frame-fitting slits 4. The slits 5 are four in total, including two slits opened upward and in the front and rear surfaces 2, 7, and two slits opened downward and in the front and rear surfaces 2, 7. Namely, the slits 5 include two front and rear upwardly opened slits 5, and two front and rear downwardly opened slits 5 formed on the opposite side of and in completely the same manner as the upwardly opened slits 5.

In each of four regions defined by the upwardly opened rear frame-fitting slits 4 and the side frame-fitting slits 5 extending at right angles thereto, one upwardly opened shelf-fitting slit 6 is provided, i.e., a total of four slits 6 are provided in these four regions. Each of the slits 6 is bent at its intermediate portion in the shape of the letter "L", one side part 6a of which extends along and in parallel with the adjacent rear frame-fitting slit 4, and the other side part 6b of which extends along and in parallel with the adjacent side frame-fitting slit 5. Four downwardly opened shelf-fitting slits 6 are provided on the opposite side of and in completely the same manner as the upwardly opened slits 6, so that a total of eight slits 6 are provided.

The constituent members of shelves assembled using the joints 1, 8 according to the present invention constructed as discussed above will now be described.

Reference numeral 9 denotes a rear frame constituting a rear surface portion of assembled shelves and formed in a quadrangular shape of a required size as shown in FIG. 5. A frame member 9a is formed flat to a thickness which permits the frame member 9a to be fitted in the rear frame-fitting slit 4 in the joint 1, 8. The frame 9 is provided at two upper end corner portions thereof with small upwardly extending projections 9b, and at two lower end corner portions thereof with small downwardly extending projections 9c.

Reference numeral 10 denotes a side frame constituting a side surface portion of a system of assembled shelves and which is formed in a quadrangular shape of a height equal to that of the rear frame 9 as shown in FIG. 6. A frame member 10a is formed flat to a thickness which permits the frame member 10a to be fitted in side frame-fitting slits 5 in the joint 1, 8. The frame 10 is provided at two upper corner portions thereof with small upwardly extending projections 10b, and at two lower end corner portions thereof with small downwardly extending projections 10c. The vertically extending portions of the frame member 10a are provided with regularly spaced screw insertion holes 10d in three parts, i.e., in an intermediate part and two other parts spaced upward and downward therefrom.

Reference numeral 11 denotes a reticulate shelf. As shown in FIG. 7, this reticulate shelf 11 includes a quadrangular frame member 11a of a required size, and a net portion 11b formed by combining rods reticulately and fixing the resultant product to the inner side of the frame member 11a. The frame member 11a is formed flat to a thickness which permits the frame member 11a to be fitted in the shelf-fitting slits 6 in the joint 1, 8.

Reference numeral 12 denotes a cleat for reticulate shelves. As shown in FIG. 8, the cleat 12 for the reticulate shelves is formed by providing an inverted U-shaped reticulate shelf-fitting member 12b on one side portion of a C-shaped rear frame-fitting member 12a so that the joint portion of the former member extends at right angles to that of the latter member. The rear frame fitting member 12a is formed to a width substantially equal to that of the rear frame 9, and the reticulate shelf-fitting member 12b is provided with a clearance 12c the width of which is substantially equal to the thickness of the frame member 11 of the reticulate shelf 11.

Reference numeral 13 denotes a lateral strip to be attached as necessary to the vertically intermediate portions of the side frame 10 so as to reinforce the side frame 10. As shown in FIG. 9, this lateral strip 13 is composed of a bar of a length substantially equal to the width of the side frame 10 provided with small elliptic holes 13a in the left and right end portions thereof.

Reference numeral 14 denotes a bar for reinforcing the front portion of assembled shelves and which is formed to a length substantially equal to the height of the side frame 10, as shown in FIG. 10.

Reference numeral 15 denotes a shelf-receiving pin. As shown in FIG. 11, the shelf-receiving pin 15 is composed of a male member 15a formed by projecting a screw portion from an end of a cylindrical element and a female member 15b formed by providing a threaded bore in another cylindrical element. Each of these cylindrical elements is covered on its circumferential surface with an elastic synthetic resin so that the reticulate shelf 11 placed thereon will not be dislocated.

The shelf assembling procedure will now be described.

Figure 12:
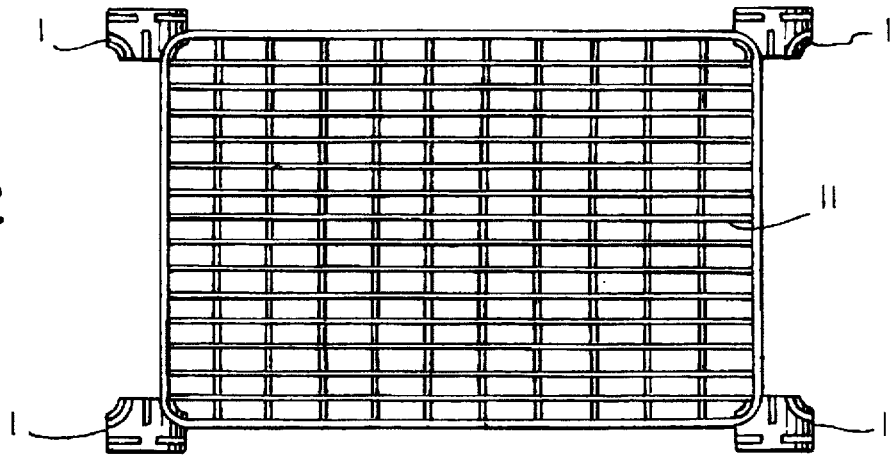
FIG. 12 is a plan view of the joints and a reticulate shelf fitted therein.
Figure 13:
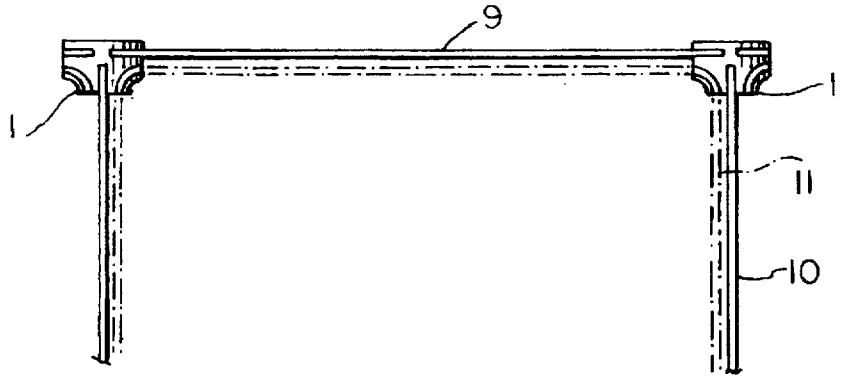
FIG. 13 is a plan view of the joints and a rear frame and left and right side frames fitted therein.

First, the four corner portions of the frame member 11a of the reticulate shelf 11 are fitted in the shelf-fitting slits 6 in first side parts of the upwardly opened portions of joints 1, and the left and fight lower end corner portions of the rear frame 9 are fitted in the rear frame-fitting slits 4 in first side parts of the upwardly opened portions of the left and right joints 1 attached to a rear portion of the reticulate shelf 11, whereby the rear frame 9 is erected on the rear side portion of the reticulate shelf 11. The left and right lower end corner portions of side frames 10 are fitted in the side frame-fitting slits 5 in the upwardly opened portions of the front and rear opposed joints 1 attached to the side frame 10, whereby the left and right side frames 10 on the reticulate shelf 11 are erected (FIGS. 12 and 13).

Figure 14:
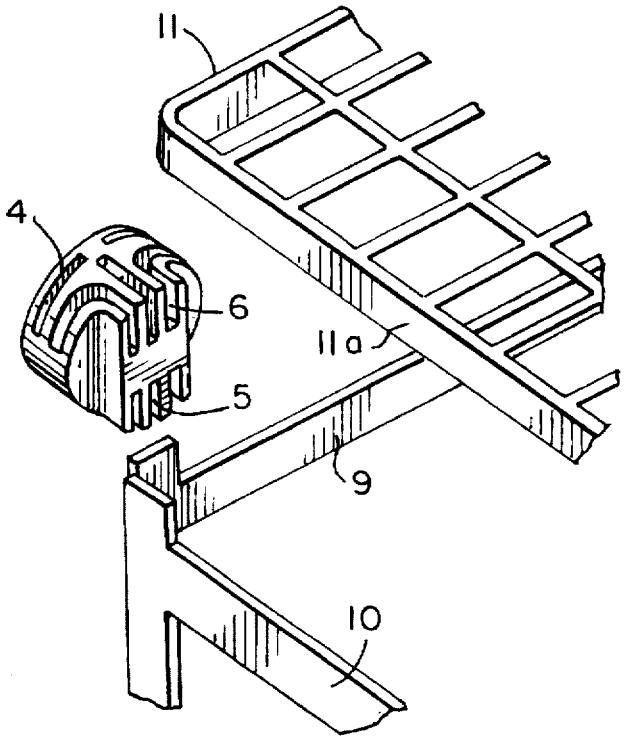
FIG. 14 is an exploded perspective view of the joint and a rear frame, a side frame and a reticulate shelf which are to be fitted therein.

The rear frame-fitting slits 4 in first side parts of the downwardly opened portions of the joints 1 in another set of joints are fitted around the left and right upper end corner portions of the erected rear frame 9, and the side frame-fitting slits 5 in first side parts of the downwardly opened portion of these joints 1 are fitted around the left and right upper end corner portions of the side frames 10, whereby the joints 1 are attached to the upper end corner portions of the one side rear frame 9 and left and right side frames 10. Consequently, the lowermost reticulate shelf 11, rear frame 9 and side frames 10 are joined together fixedly (FIG. 14).

In order to reinforce a front opened part of the front portion of the resultant structure, a front portion reinforcing bar 14 is fitted in the rear frame-fitting slits 4 in the upper and lower joints 1 so that the bar 14 extends between the joints 1 (FIG. 15).

In order to reinforce the side frames 10, the lateral strips 13 are fixed in some cases by inserting screws 16 into the screw insertion holes 13*a*, 13*b*.

In order to assemble a second stage portion of the shelves, the same procedure as that using in assembling the lowermost shelf is employed. Namely, a reticulate shelf 11 is fitted in the upwardly opened shelf-fitting slits 6 in the joints 1 attached to the upper end portion of the lower stage structure and the lower end corner portions of a rear frame 9 in the upwardly opened rear frame-fitting slits 4, side frames 10 being fitted in the upwardly opened side frame-fitting slits 5, whereby these frames are erected. The downwardly opened rear frame-fitting slits 4 in another set of joints 1 are fitted around the upper end corner portions of the erected rear frame 9, and the downwardly opened side frame-fitting slits 5 around the upper end portions of the side frames 10, so that the joints 1 are attached to the upper end corner portions of the rear frame 9 and left and right side frames 10. As a result, the second reticulate shelf 11, rear frame 9 and side frames 10 are joined together fixedly (FIG. 15).

In order to provide a shelf 11 in a vertically intermediate portion of the space between the shelves fitted in the joints 1, shelf-receiving pins 15 are set pivotably in the screw insertion holes 10*c* of a required height in the side frames 10, and a reticulate shelf 11 is placed on the shelf-receiving pins 15. In order to prevent the reticulate shelf 11 from being dislocated, the rear frame-fitting members 12*a* of the cleats 12 therefor are fitted around the rear frame 9, and the shelf-fitting members 12*b* around the frame portion of the reticulate shelf 11, to fix the reticulate shelf 11 (FIG. 20).

In order to assemble shelves on the upper stages, a procedure identical with that used in assembling the shelves on the first and second stages is employed.

In order to connect two more rows of shelves in the widthwise direction to a row of already-assembled shelves, the reticulate shelves 11, rear frames 9 and side frames 10 are fitted in completely the same manner as in the assembly operation for the first row of shelves in the shelf-fitting slits 6, rear frame-fitting slits 4 and side frame-fitting slits 5, all of which are provided in the other side parts of the already-installed joints 1. In order to connect more shelves in the widthwise direction, reticulate shelves 11, rear frames 9 and side frames 10 are fitted in the joints 1 in the same manner (FIGS. 16 and 17).

Figure 19:
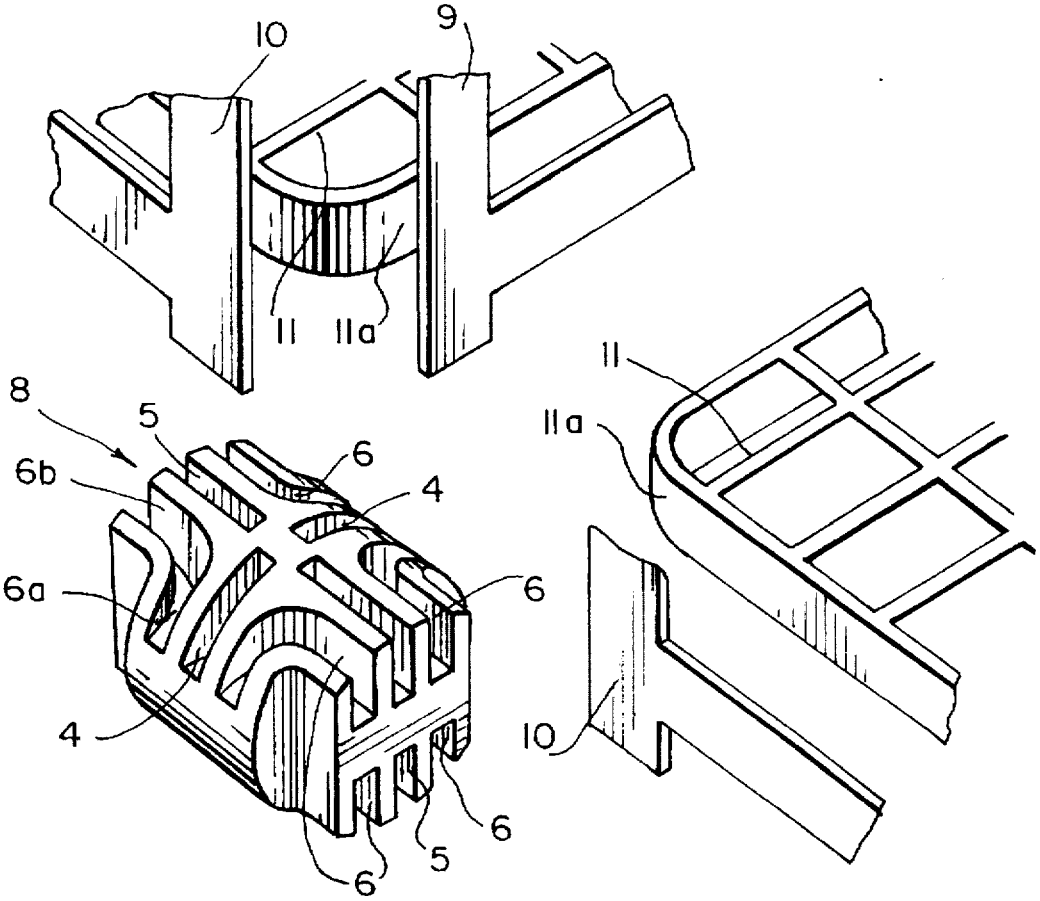
FIG. 19 is a perspective view of two rows of shelves to be assembled in the depthwise direction.

In order to assemble not less than two rows of shelves in the depthwise direction, the joints 8 are used as shown in FIGS. 18 and 19. In this case, the joints 8 are fixed to the rear portion of the front row of shelves, and the rear frames 9 in the front row are fitted in the rear frame-fitting slits 4, the side frames 10 in the front and rear rows being fitted in the front and rear side frame-fitting slits 5, the reticulate shelves 11 in the front and rear rows being fitted in the front and rear shelf-fitting slits 6, whereby these shelves are assembled.

The joint for modular shelves according to the present invention described above is formed so that the rear frames, side frames and shelves which constitute a two-stage portion of a skeletal structure of a modular shelves can be connected together by one joint. Moreover, since shelves can be assembled by simple fitting operations, no special jigs are required, and the shelves can be assembled by virtually anyone in a short period of time. Even when the modular shelves are disassembled so as to change the place of installation thereof, to rearrange the room in which the shelves are installed, or to put away things from the shelves, such purpose can be met simply and in a short period of time by merely disengaging the connected portions.

In the modular shelves assembled by these joints, the connecting portions of primary members can be joined together in one joint by fitting those portions in the slits in the joint. Accordingly, the shelves are fixed firmly and stably, and they rarely become shaky.

What is claimed is:

1. A joint for modular shelves, comprising a flattened columnar body one end surface of which forms a front surface, and another, opposite end surface of which forms a rear surface, characterized in that at least one circumferential side surface of said flattened columnar body is provided with a plurality of slits comprising rear frame-fitting slits extending to left and right side surface and in parallel with said front surface, side frame-fitting slits extending at right angles to said rear frame-fitting slits, and L-shaped shelf-fitting slits which comprise first side parts extending along said rear frame-fitting slits and second side parts extending along said side frame-fitting slits, and which are provided on left and right sides of said side frame-fitting slits, each of said rear frame-fitting slits, said side frame-fitting slits, and said L-shaped shelf-fitting slits comprising upwardly opened slits and downwardly opened slits.

2. A joint for modular shelves according to claim 1, wherein said rear surface is cut off so as to form curved recesses.

3. A joint for built up shelves according to claim 1, wherein opposed circumferential side surfaces of said flattened columnar body are each provided with said plurality of slits.

4. A joint for modular shelves according to claim 3, wherein said joint comprises a flattened columnar body, both end surfaces of which are cut off so as to form curved recesses.

5. A modular shelf comprising: a plurality of joints, each of said joints comprising a flattened columnar body one end surface of which forms a front surface, and another, opposite end surface of which forms a rear surface, said joints being characterized in that at least one circumferential side surface of said flattened columnar body is provided with a plurality of slits comprising rear frame-fitting slits extending to left and right side surface and in parallel with said front surface, side frame-fitting slits extending at right angles to said rear frame-fitting slits, and L-shaped shelf-fitting slits which comprise first side parts extending along said rear frame-fitting slits and second side parts extending along said side frame-fitting slits, and which are provided on left and right sides of said side frame-fitting slits, each of said rear frame-fitting slits, said side frame-fitting slits, and said L-shaped shelf-fitting slits comprising upwardly opened slits and downwardly opened slits; a plurality of quadrangular rear frames, quadrangular side frames and reticulate shelves assembled together with said joints, each of said rear frames being fitted in said rear frame-fitting slits in corresponding ones of said joints, each of said side frames being fitted in said side frame-fitting slits in corresponding ones of said joints, and each of said frame members of said reticulate shelves being fitted in said shelf-fitting slits in corresponding ones of said joints.

6. A modular shelf according to claim 5, further comprising a plurality of shelf-receiving pins and a plurality of cleats, said side frames being provided at vertically intermediate portions thereof with shelf-receiving pin insertion holes through which corresponding ones of said shelf-receiving pins are inserted fixedly, said shelves being placed on said pins, said cleats being fixed astride parts of said shelves and relative parts of said rear frames.

7. A modular shelf according to claim 6, wherein each of said shelf-receiving pins comprises a male member formed by providing a projecting screw portion on an end of a cylindrical element, and a female member formed by providing a threaded bore in another cylindrical element, outer surfaces of said cylindrical elements being covered with an elastic material.

8. A modular shelf according to claim 6, wherein each of said cleats is formed by an inverted U-shaped reticulate shelf-fitting member on one side portion of a U-shaped rear frame fitting member.

* * * * *